US010040083B2

(12) United States Patent
Barenhoff et al.

(10) Patent No.: US 10,040,083 B2
(45) Date of Patent: Aug. 7, 2018

(54) DISPENSING DEVICE

(71) Applicant: APTAR DORTMUND GMBH, Dortmund (DE)

(72) Inventors: Swen Barenhoff, Boenen (DE); Bernd Jasper, Waltrop (DE)

(73) Assignee: APTAR DORTMUND GMBH, Dortmund (DE)

( * ) Notice: Subject to any disclaimer, the term of this patent is extended or adjusted under 35 U.S.C. 154(b) by 2 days.

(21) Appl. No.: 15/113,549

(22) PCT Filed: Apr. 19, 2014

(86) PCT No.: PCT/EP2014/001081
§ 371 (c)(1),
(2) Date: Jul. 22, 2016

(87) PCT Pub. No.: WO2015/117625
PCT Pub. Date: Aug. 13, 2015

(65) Prior Publication Data

US 2017/0001208 A1 Jan. 5, 2017

(30) Foreign Application Priority Data

Feb. 10, 2014 (DE) ..... 20 2014 001 084 U

(51) Int. Cl.
*B67B 1/00* (2006.01)
*B05B 11/00* (2006.01)
(Continued)

(52) U.S. Cl.
CPC ..... *B05B 11/0032* (2013.01); *B05B 11/0056* (2013.01); *B05B 11/3059* (2013.01);
(Continued)

(58) Field of Classification Search
CPC ..... B65D 83/22; B65D 83/205; B65D 83/20; B65D 83/40; B65D 2255/00;
(Continued)

(56) References Cited

U.S. PATENT DOCUMENTS 3,263,868 A * 8/1966 Sagarin ..... B65D 83/205 137/382
3,422,996 A * 1/1969 Lipman ..... B05B 11/3059 222/384
(Continued)

FOREIGN PATENT DOCUMENTS

DE 1037378 A 8/1958
DE 29610372 U1 10/1996
(Continued)

OTHER PUBLICATIONS

FR76993_MT, M. Carcone, Dec. 29, 1961, machine translation of FR76993.*
(Continued)

*Primary Examiner* — J. Casimer Jacyna
*Assistant Examiner* — Randall Gruby
(74) *Attorney, Agent, or Firm* — Jason H. Vick; Sheridan Ross, PC

(57) ABSTRACT

Disclosed is a dispensing device comprising a housing, a spray head, and a protective cap. By overcoming a resistance, the protective cap can be rotated between a blocked position and a released position. The protective cap is transparent and is rotationally coupled to the spray head.

34 Claims, 8 Drawing Sheets

(51) Int. Cl.
*B65D 83/22* (2006.01)
*B65D 83/40* (2006.01)

(52) U.S. Cl.
CPC ..... *B65D 83/22* (2013.01); *B65D 83/40* (2013.01); *B65D 2255/00* (2013.01)

(58) Field of Classification Search
CPC ..... B65D 2255/20; B65D 47/2012; B05B 11/3049; B05B 11/3059; B05B 11/0027
See application file for complete search history.

(56) References Cited

U.S. PATENT DOCUMENTS 3,484,023 A * 12/1969 Meshberg ..... B65D 83/205 222/402.11
3,754,689 A * 8/1973 Blank ..... B65D 83/205 222/402.11
5,027,982 A * 7/1991 Demarest ..... B65D 83/205 222/182
5,411,185 A * 5/1995 Drobish ..... B05B 1/1645 222/402.17
5,772,080 A * 6/1998 de Pous ..... B05B 11/3049 222/153.13
7,017,785 B2 * 3/2006 Lasserre ..... B65D 83/205 222/153.11
7,104,424 B2 * 9/2006 Kolanus ..... B65D 83/206 177/245
7,487,891 B2 2/2009 Yerby et al.
7,527,173 B2 * 5/2009 Lasserre ..... B65D 83/205 222/153.11
8,127,968 B2 3/2012 Yerby et al.
8,439,230 B2 5/2013 Hagen
8,695,852 B2 * 4/2014 Bertin ..... B05B 11/0032 222/153.13
8,863,994 B2 * 10/2014 Neuhaus ..... B05B 11/0027 222/402.13
2002/0096539 A1 * 7/2002 Milian ..... B05B 11/0027 222/153.11
2008/0023498 A1 * 1/2008 Bertin ..... B05B 11/0032 222/402.12
2008/0116232 A1 * 5/2008 Michaux ..... B05B 11/3049 222/507
2008/0210710 A1 * 9/2008 Marquardt ..... B65D 83/206 222/153.11
2009/0218369 A1 * 9/2009 Carnacina ..... B05B 11/3049 222/153.11
2011/0031282 A1 2/2011 Hagen
2012/0024899 A1 * 2/2012 Michaux ..... B65D 83/22 222/153.13
2013/0200107 A1 * 8/2013 Presche ..... B05B 11/0032 222/153.13

FOREIGN PATENT DOCUMENTS

DE 102009017105 A1 10/2009
FR 76993 E 12/1961
GB 1419263 12/1975
WO WO 2004/078635 9/2004

OTHER PUBLICATIONS

International Preliminary Report on Patentability for corresponding International Application No. PCT/EP2014/001081, dated Aug. 25, 2016.
International Search Report for corresponding International Application No. PCT/EP2014/001081, dated Feb. 2, 2015.

* cited by examiner

DISPENSING DEVICE

CROSS REFERENCE TO RELATED APPLICATIONS

This application is a national stage application under 35 U.S.C. 371 of PCT Application No. PCT/EP2014/001081 having an international filing date of 19 Apr. 2014 which designated the United States, which PCT application claimed the benefit of German Application No. 20 2014 001 084.6 filed 10 Feb. 2014, each of which are incorporated herein by reference in their entirety.

The present invention relates to a dispensing device according to the claims as appended hereto.

In the present invention, the term "dispensing device" is to be understood particularly as a spraying device or pump device that preferably is or can be mounted on a container. In particular, the dispensing device can comprise the container, optionally a pressurized container.

The dispensing device is preferably used for delivering or dispensing a product as a spray.

The term "product" is to be understood particularly as also including liquids, suspensions and fluids, optionally with gas phases. The product can be delivered as a paste, stream or mist or in another manner, for example also as a foam or gel.

DE 1 037 378 A discloses a spray head for a pressurized container with a rotatable, non-detachable protective cap.

It is the object of the present invention to provide a dispensing device that enables and/or supports intuitive and/or reliable handling with a simple and cost-effective construction.

The above object is achieved by a dispensing device according to the claims as appended hereto. Advantageous embodiments are subject of the subclaims.

One aspect of the present invention is that the dispensing device preferably forms a resistance that must be overcome when rotating the protective cap from the unblocked position to the blocked position and/or vice versa. This is conducive to secure handling and prevents undesired rotation of the protective cap from one position to the other.

According to another aspect of the present invention, the dispensing device preferably has a protective cap and a spray head that are preferably coupled directly by means of a rotary coupling such that they are limited in their rotation relative to one another, particularly wherein, upon rotation of the protective cap from the blocked position into the unblocked position, the spray head is rotated along with it into a predetermined delivery direction if the spray head has been twisted toward the blocked position. This is conducive to reliable handling, particularly since the spray head is prevented from being rotated inadvertently in an undefined delivery direction. Moreover, this enables a simple construction, since the depressible spray head need not be guided in a rotationally fixed manner on the associated housing or in the dispensing device.

According to another aspect of the present invention, the protective cap is preferably transparent. This is conducive to intuitive actuation, particularly since a user can identify the spray head and especially preferably its nozzle or delivery opening in the blocked position as well.

The abovementioned aspects of the present invention, as well as those which follow from the description that follows, can be implemented independently of one another or also in any combination.

Additional advantages, features, characteristics and aspects of the present invention follow from the claims and the following description of a preferred embodiment with reference to the drawing.

In the partially not-to-scale, merely schematic figures, the same reference symbols are used for same or similar parts, with corresponding or comparable characteristics and advantages being achieved even if a repeated description is omitted.

FIG. 1 shows a schematic section of a proposed dispensing device 1 for dispensing a product 2, such as a liquid or the like.

Figure 1:
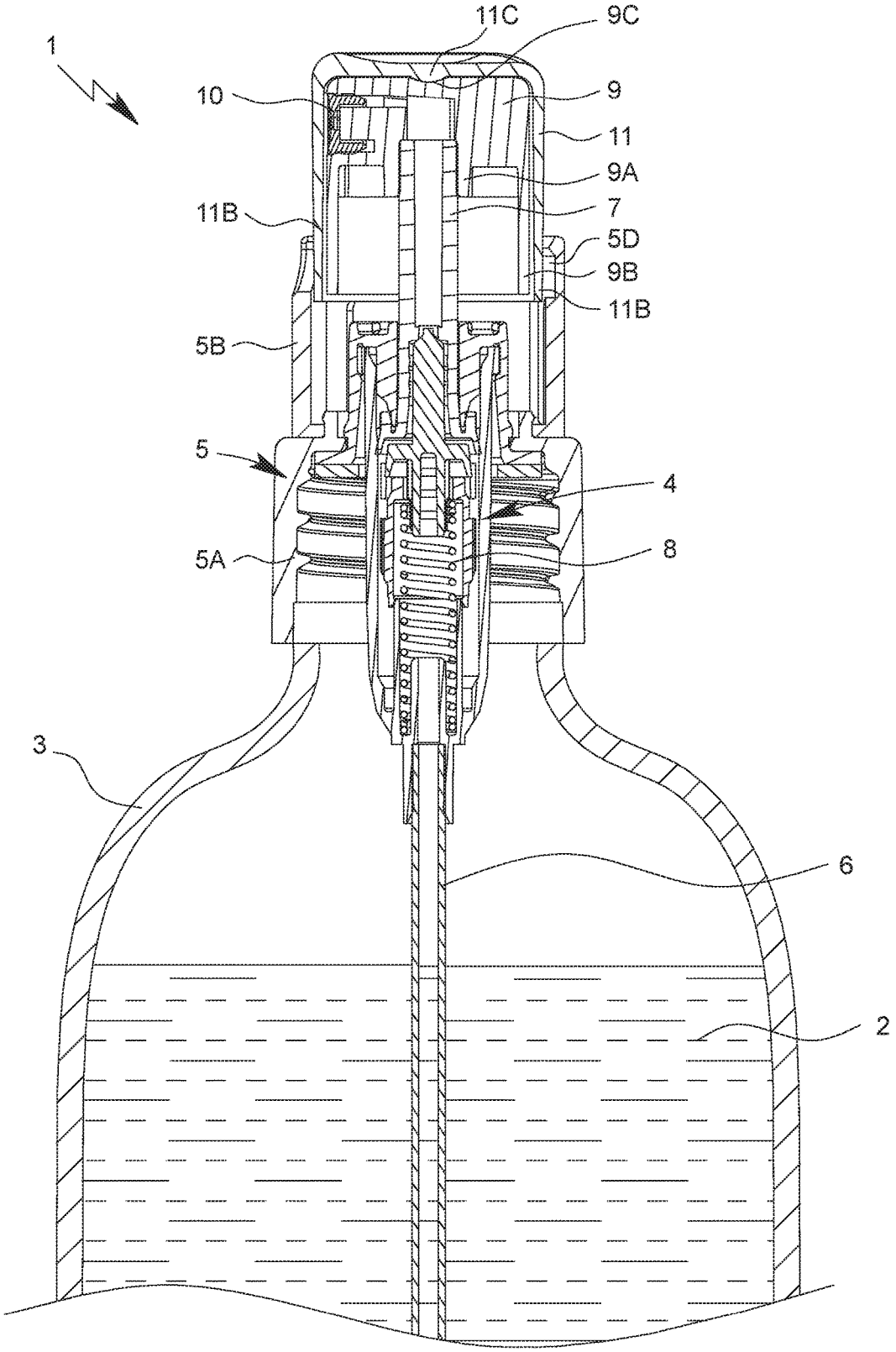
FIG. 1 shows a schematic section of a proposed dispensing device with a container in the non-actuated state.

The product 2 can be more viscous than water or, optionally, even pasty.

In particular, the product 2 can also form a foam or a gel.

The product 2 can also contain gas in liquid and/or another form.

It should be noted that, in principle, any type of dispensing of the product 2—preferably as a stream or as atomized spray—merits consideration.

Particularly, the dispensing device 1 is designed to dispense the product 2 in the form of a spray. However, non-spraying delivery is also possible.

The dispensing device 1 is preferably provided with or is or can be connected to a reservoir, particularly a container 3, for the product 2 to be delivered. The reservoir can thus form part of the dispensing device 1 or be connected or connectable thereto. Preferably, the dispensing device has the container 3.

In the depicted example, the reservoir is embodied as a preferably rigid container 3. The container 3 is particularly elongate and/or cylindrical and/or rigid.

The dispensing device 1 preferably has a pump 4 or is preferably embodied as such in order to suction or to convey the product 2 from the reservoir or container 3 and/or to pressurize and deliver same.

Alternatively, however, the product 2 can also be pressurized or pressurizable in the reservoir or container 3. For example, the container 3 or the product 2 can contain a suitable propellant.

The dispensing device 1 has a housing 5 that can be connected or whose mounting portion 5A can be connected preferably by means of a screw connection or in another suitable manner to the container 3.

Especially preferably, the housing 5 can be connected detachably to the container 3, particularly in order to refill the product 2 and/or to exchange the container 3. However, a nondetachable connection is also possible.

Preferably, the pump 4 is inserted or built into the housing 5, particularly received by same in a locking manner. However, other structural solutions are also possible.

The dispensing device 1 or pump 4 preferably has a riser tube 6, for example a hose, for enabling the product 2 to be suctioned or taken up from the container 3. The riser tube 6 is connected to an inlet of the pump 4, particularly inserted into or mounted onto an adaptor.

On the outlet side, the pump 4 has a preferably tubular or nozzle-like outlet element 7.

The pump 4 can be actuated through depression of the outlet element 7. FIG. 1 shows the pump 4 in a non-actuated initial position into which the outlet element 7 or the pump 4 returns as a result of a resilient force, here through the force of a return spring 8.

The dispensing device 1 has a spray head 9 for the preferably atomized delivery of the product 2, preferably via a delivery opening or nozzle 10 on or in the spray head 9. In the depicted example, the nozzle 10 is inserted into the spray head 9. An atomized delivery of the product 2 preferably occurs.

The spray head 9 is fluidically connected to the pump 4 or to its outlet element 7, especially preferably with an inlet 9A, such as a connecting piece, mounted onto the outlet element 7.

Instead of the pump 4, the dispensing device 1 or the container 3 can also have a dispensing valve, particularly if the product 2 in the container 3 is pressurized. In that case, the outlet element 7 then forms a valve element of the dispensing valve. The spray head 9 or its inlet 9A is then connected to the dispensing valve or to its valve element.

The dispensing device 1 has a protective cap 11 that covers or encloses the spray head 9. In particular, the protective cap 11 covers the spray head 9 on its upper side or front side and also laterally or over its periphery.

The protective cap 11 preferably has a passage opening 11A through which the product 2 can be delivered upon actuation of the dispensing device 1, particularly upon depression of the spray head 9 or of the protective cap 11.

FIG. 1 shows the dispensing device 1 and the protective cap 11 in a blocked position. In this blocked position, the protective cap 11 is locked against manual depression. Accordingly, the spray head 9 is thus also locked against manual depression.

In the blocked position, the protective cap 11 preferably covers the delivery opening or nozzle 10 of the spray head 9. In the blocked position, the passage opening 11A shown in FIG. 2 is therefore not located in front of the outlet opening or nozzle 10.

Figure 2:
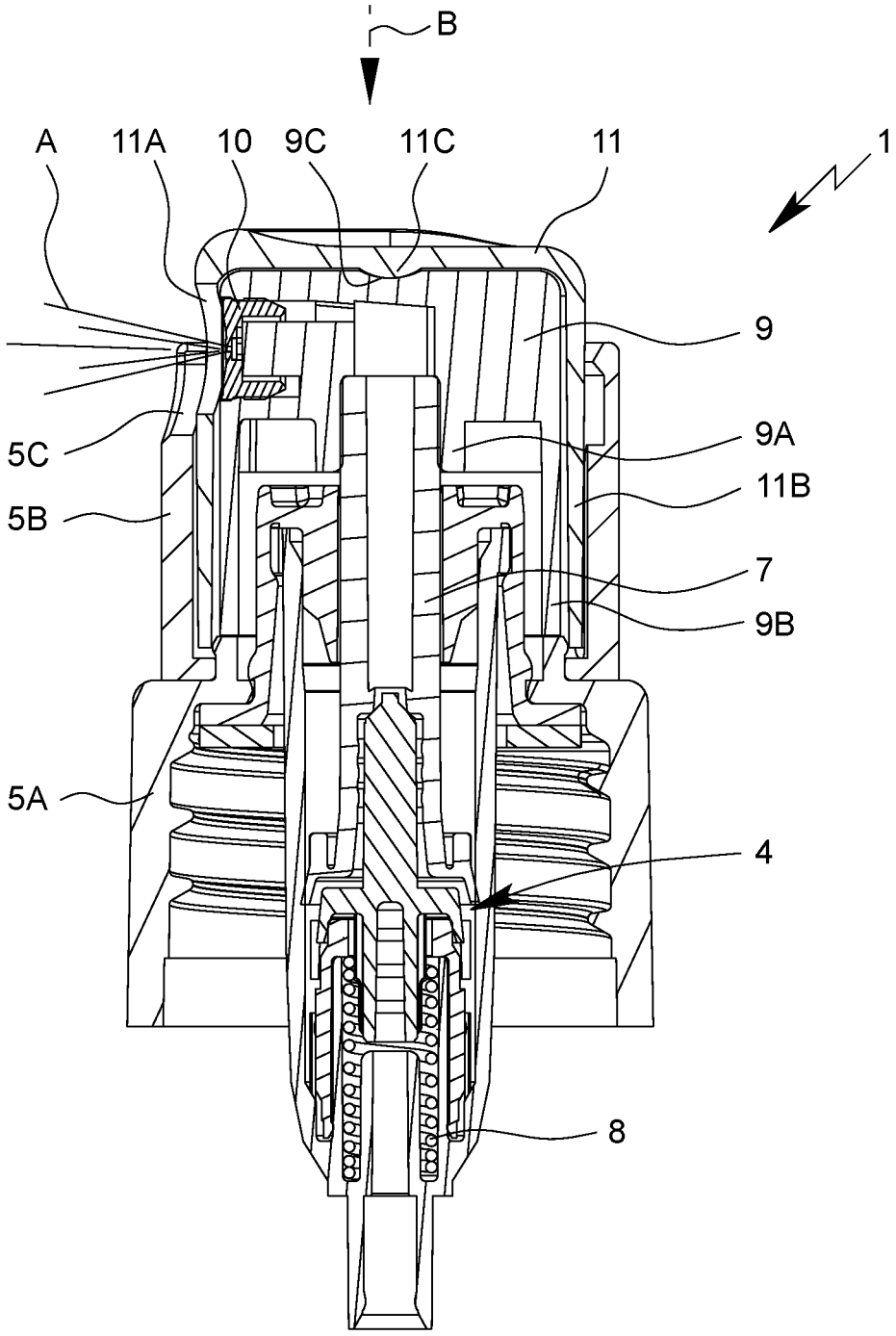
FIG. 2 shows a schematic section of the dispensing device without container in the actuated state.

FIG. 2 shows the dispensing device 1 in a schematic section without container 3. For the sake of simplicity, the riser tube 6 has also been omitted.

The protective cap 11 is in the unblocked position. The passage opening 11A is located in front of the delivery opening or nozzle 10 of the spray head 9 and unblocks same.

FIG. 2 shows the dispensing device 1 in the actuated state, i.e., with depressed protective cap 11 and depressed spray head 9. During depression, the pumping of the product 2 and the delivery of the product 2 pressurized by the pump 4 or the actuation of the pump 4 via the spray head 9 or its nozzle 10, preferably as a spray jet or atomized spray, occurs as indicated schematically in FIG. 2.

In the normal operating position, the delivery direction A is preferably at least substantially horizontal and/or runs transverse, preferably perpendicular, to the direction of actuation or direction of depression B, which is indicated schematically in FIG. 2.

The housing 5 preferably has an upper portion or annular collar 5B, which is particularly open in the upward direction to receive the spray head 9 and the protective cap 11.

The mounting portion 5A and the annular collar 5B can be formed by separate parts that are interconnected in a locking manner, for example. Alternatively, however, they can also be integrally formed. Especially preferably, the housing 5 is then embodied as a single piece overall. This is conducive to cost-effective manufacturing and assembly.

The spray head 9 is preferably embodied so as to be cap-like. It preferably projects with an annular portion or sleeve portion 9B into the housing 5 or its annular collar 5B, especially preferably both in the non-actuated or non-depressed position (FIG. 1) and in the actuated position or depressed position (FIG. 2). Upon actuation, the spray head 9 can thus be retracted or pushed into the housing 5 accordingly.

The protective cap 11 is preferably transparent. This is conducive to intuitive usage or handling of the dispensing device.

The protective cap 11 covers the spray head 9, preferably substantially in its entirety, particularly in such a way that the spray head 9 cannot be directly manually actuated or depressed, but can only be depressed through depression of the protective cap 11 itself in order to actuate the pump 4 or to open a dispensing valve (not shown).

Especially preferably, the protective cap 11 or its sleeve portion 11B covers the spray head 9 on its front side or its upper side and/or its peripheral side. Especially preferably, the protective cap 11 has a jacket or sleeve portion 11B that covers the sleeve portion 9B of the spray head 9.

In the depicted example, the protective cap 11 projects over the spray head 9 toward the direction of actuation B or toward the container 3, thus projecting farther toward the container 3 than the spray head 9.

The protective cap 11 can be rotated between the unblocked position and the blocked position.

The protective cap 11 can be rotated or twisted relative to the spray head 9.

Preferably, the protective cap 11 is held in the upper or non-actuated position by the spray head 9, which is biased into the initial position by the force of the return spring 8 in the depicted example. The resilient force is preferably selected such that the spray head 9 and the protective cap 11 return automatically and reliably into the non-actuated position or initial position after actuation, but not so high that manual actuation, particularly by pressing on the outer or free front face of the protective cap 11, is not too difficult for a user (not shown).

To prevent the twisting of the protective cap 11 relative to the spray head 9 from being too difficult, a pivot bearing is preferably provided between them. This is especially preferably embodied as a central or punctiform pivot bearing.

The protective cap 11 has for pivot bearing preferably a mounting portion 11C that engages particularly axially on the spray head 9 and/or enables easy twisting of the protective cap 11 relative to the spray head 9.

The mounting portion 11C is preferably arranged in the center or middle.

The mounting portion 11C is preferably embodied as a lenticular raised area and/or arranged or integrally formed on the interior of the protective cap 11 or of its front face.

The mounting portion 11C preferably engages in an at least substantially complementary recess in the spray head 9.

Especially preferably, the pivot bearing or the mounting portion 11C ensures that the protective cap 11 does not rest with its entire surface against the front face of the spray head 9, thus facilitating the rotation of the protective cap 11 relative to the spray head 9.

Alternatively, the mounting portion can also be formed on the spray head 9 and engage in a corresponding recess in the protective cap 11.

Figure 3:
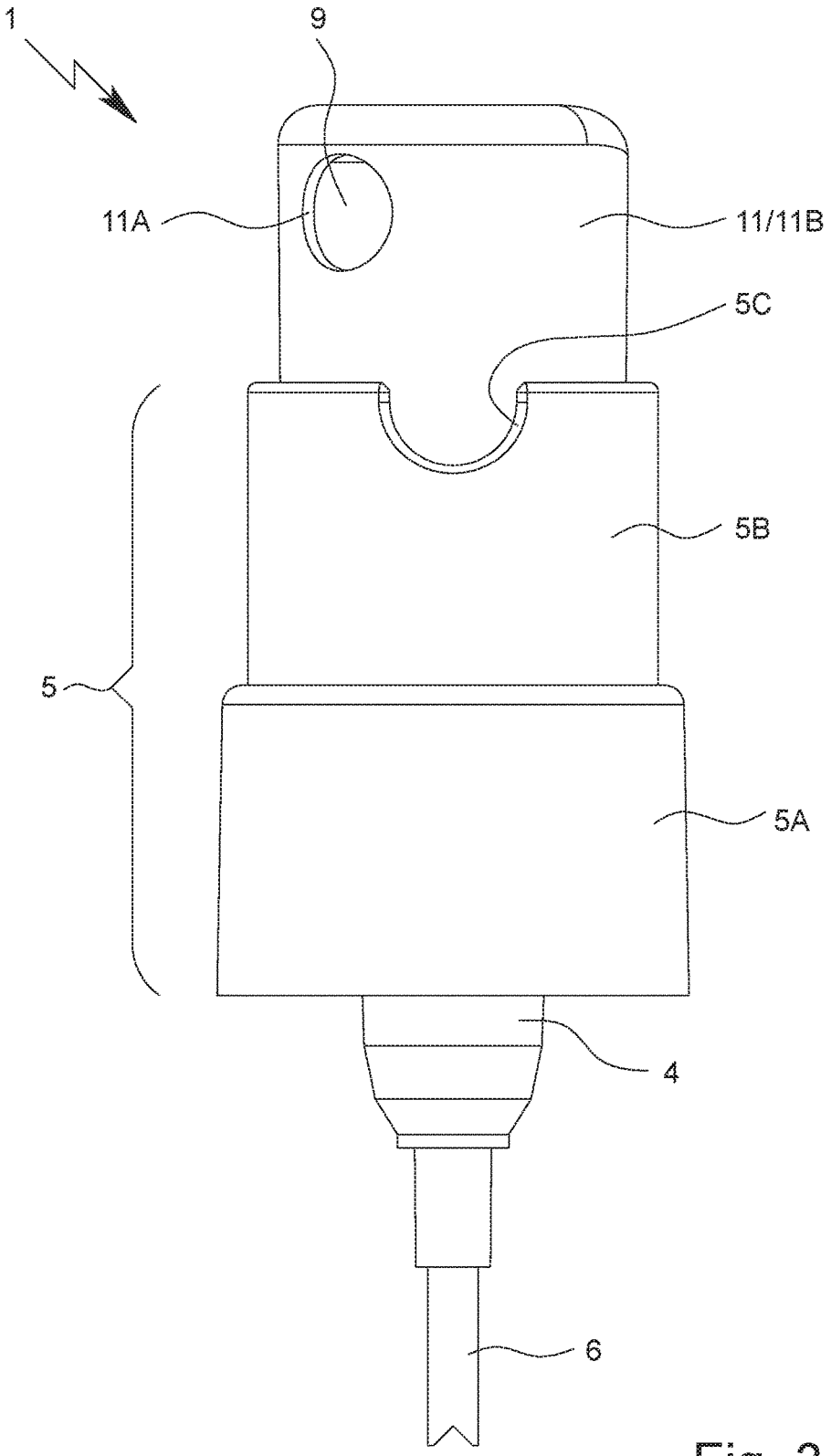
FIG. 3 shows a schematic side view of the dispensing device in a blocked position without container.

FIG. 3 shows a side view of the dispensing device 1 without container 3 in the blocked position, that is, in the position of the protective cap 11 corresponding to FIG. 1. The passage opening 11A is twisted here in relation to the nozzle 10, whereby the protective cap 11 or its sleeve portion 11B covers the nozzle 10 of the spray head 9. This indicates to a user that the dispensing device 1 cannot be actuated or used in this state.

Figure 4:
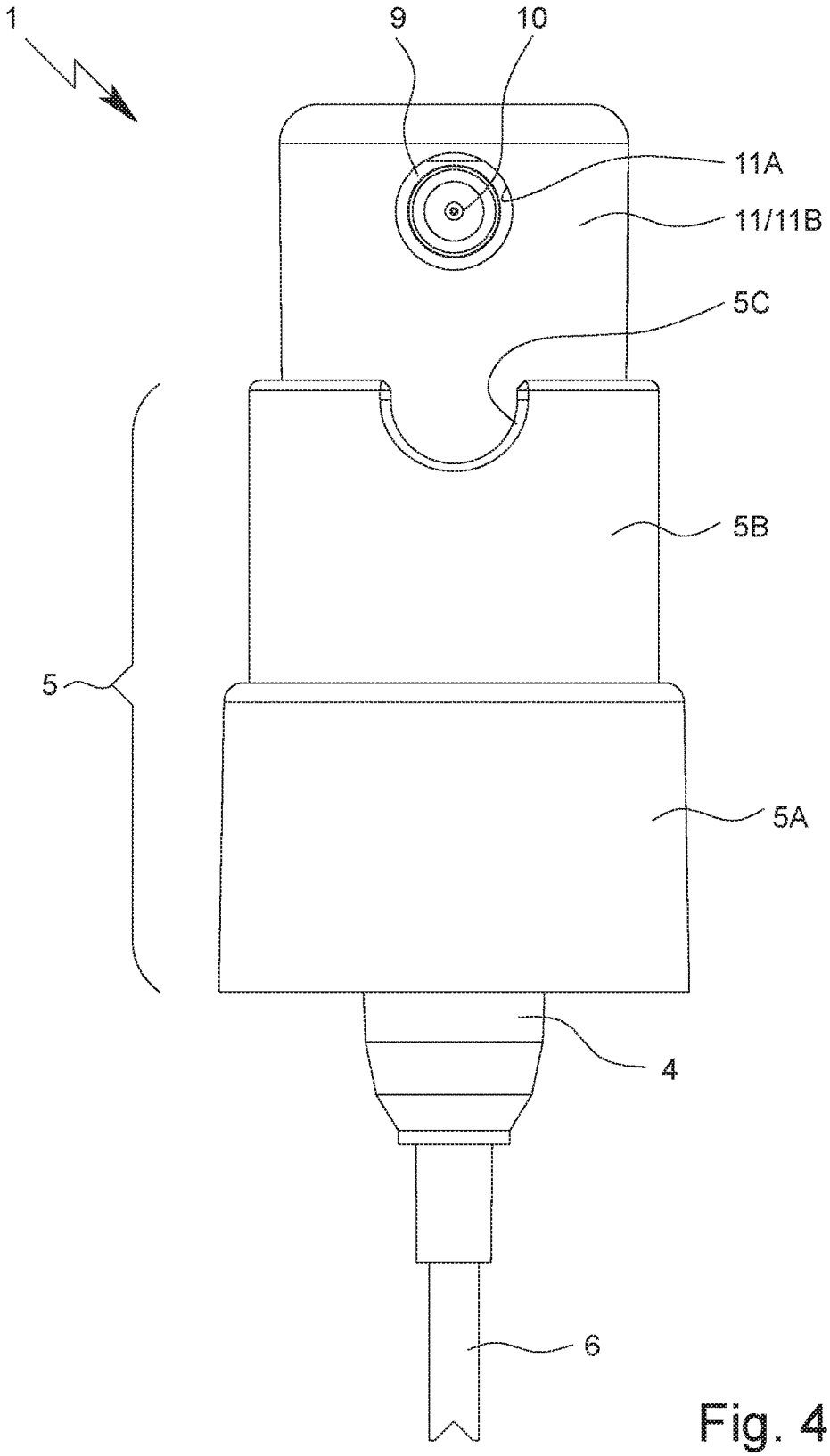
FIG. 4 shows a schematic side view of the dispensing device in an unblocked position without container.

In a representation corresponding to FIG. 3, FIG. 4 shows the dispensing device 1 without container 3 with the protective cap 11 in the unblocked position in the non-actuated state. Here, the passage opening 11A unblocks the nozzle 10.

Figure 5:
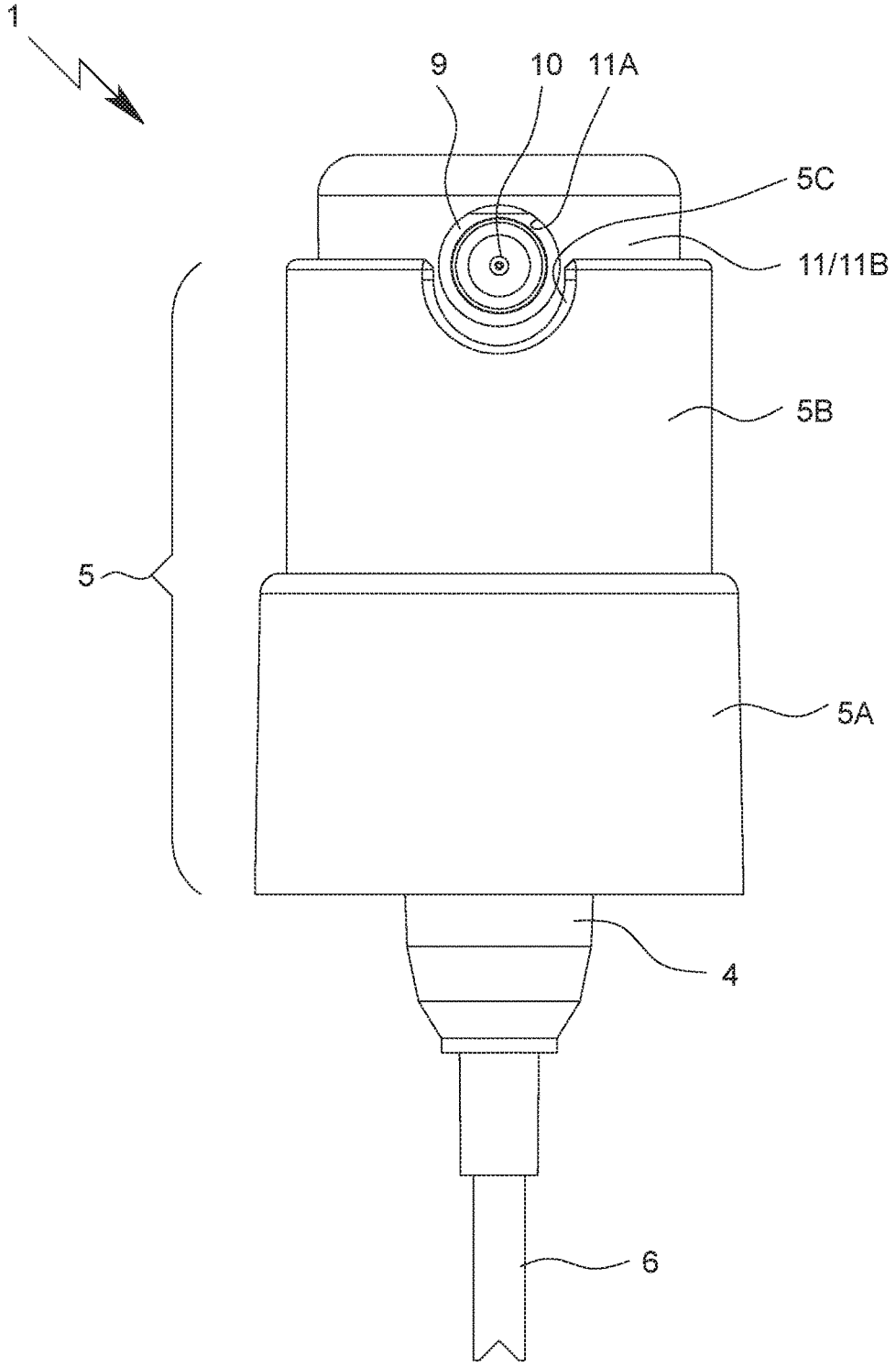
FIG. 5 shows a schematic side view of the dispensing device in the depressed state without container.

In a representation corresponding to FIG. 4, FIG. 5 shows the dispensing device 1 in the actuated state, that is, with depressed protective cap 11.

Preferably, the housing 5 or its annular collar 5B has a recess or notch 5C on the upper edge, thus enabling the nozzle 10 to retract into the annular collar 5B in the depressed final position of the spray head 9 and deliver the product in a desired manner through the recess 5C.

Preferably, the protective cap 11 can be depressed only in the unblocked position. In the blocked position, in contrast, the protective cap 11 is locked against depression. This will be explained in further detail below with reference to FIGS. 6 and 7.

In the depicted example, the dispensing device 1 or its housing 5, particularly the annular collar 5B, preferably has a recess 5D that forms a slotted guide or movement path for a preferably radially projecting retention portion 11D of the protective cap 11. In a schematic section of the housing 5, FIG. 6 illustrates a preferred embodiment of the recess 5D and indicates, with a broken line, the position of the portion 11D in the blocked position of the protective cap 11.

The recess 5D or slotted guide comprises a first portion extending in the circumferential direction and a second portion extending in the direction of actuation B or in the axial direction.

Figure 6:
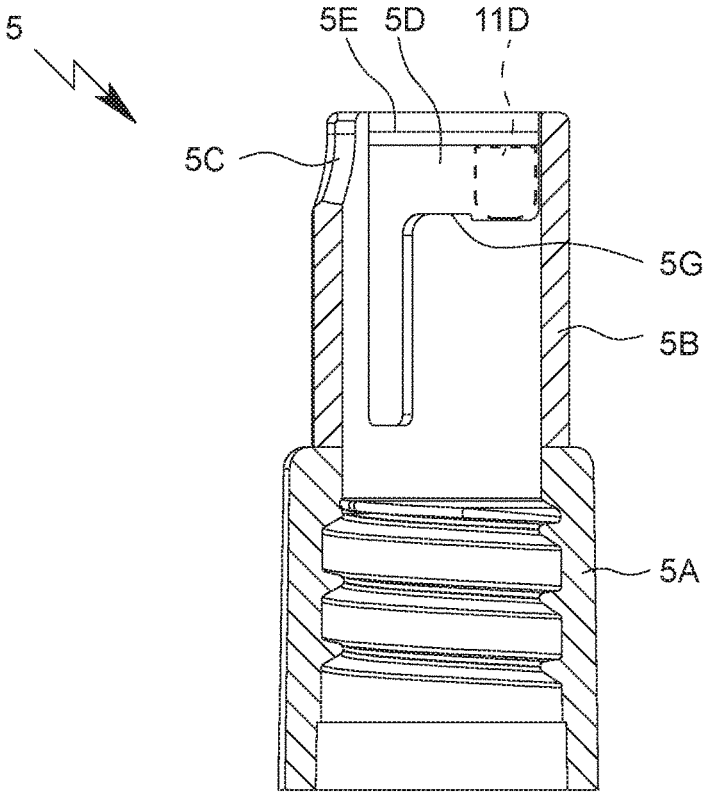
FIG. 6 shows a schematic section of a housing of the dispensing device with an engaging retention section of a protective cap in the blocked position.

Starting from the position of the retention portion 11D in the blocked position indicated in FIG. 6, upon rotation of the protective cap 11 from the blocked position into the unblocked position, the retention portion 11D is moved along the first portion in the recess 5D, i.e., in the circumferential direction.

Figure 7:
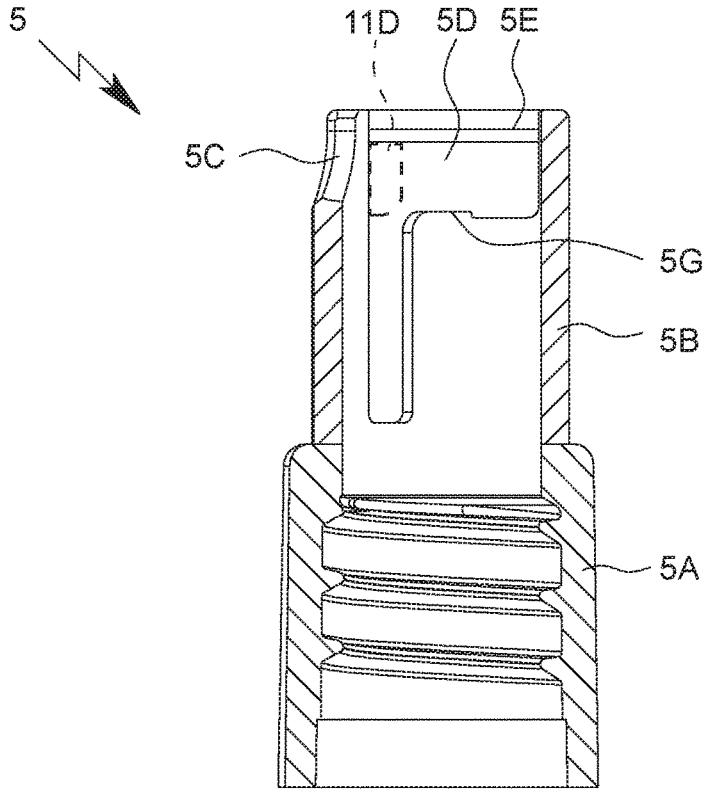
FIG. 7 shows a schematic section of the housing of the dispensing device with the engaging retention section of the protective cap in the unblocked position.

In the unblocked position, the retention portion 11D projects over the second portion of the recess 5D. This state is indicated in FIG. 7. In this representation, the retention portion 11D appears narrower as a result of the curvature.

Figure 8:
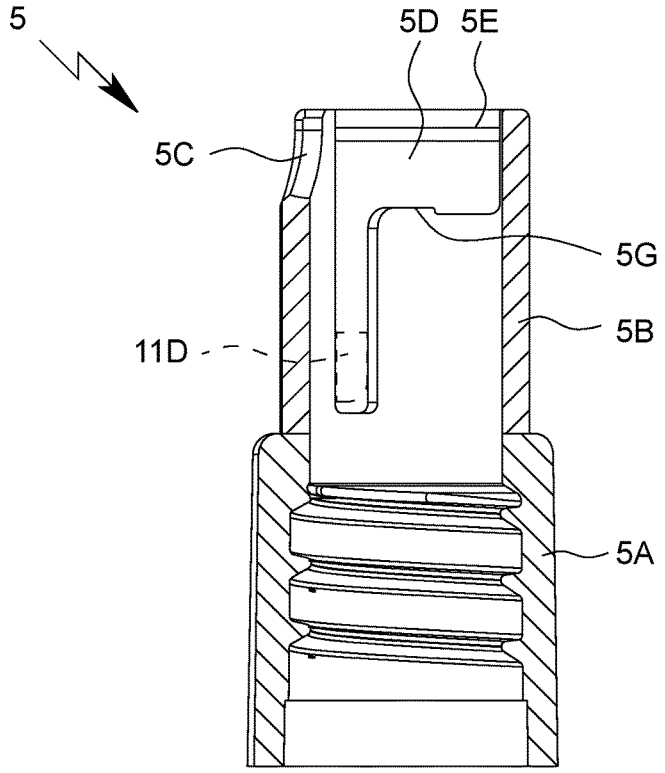
FIG. 8 shows a schematic section of the housing of the dispensing device with the engaging retention section of the protective cap in the depressed state.

In the unblocked position, the protective cap 11 can be depressed. As a result, the retention portion 11D is moved in the recess 5D along the second portion downward and further into the housing 5. FIG. 8 illustrates the depressed final position.

Figure 9:
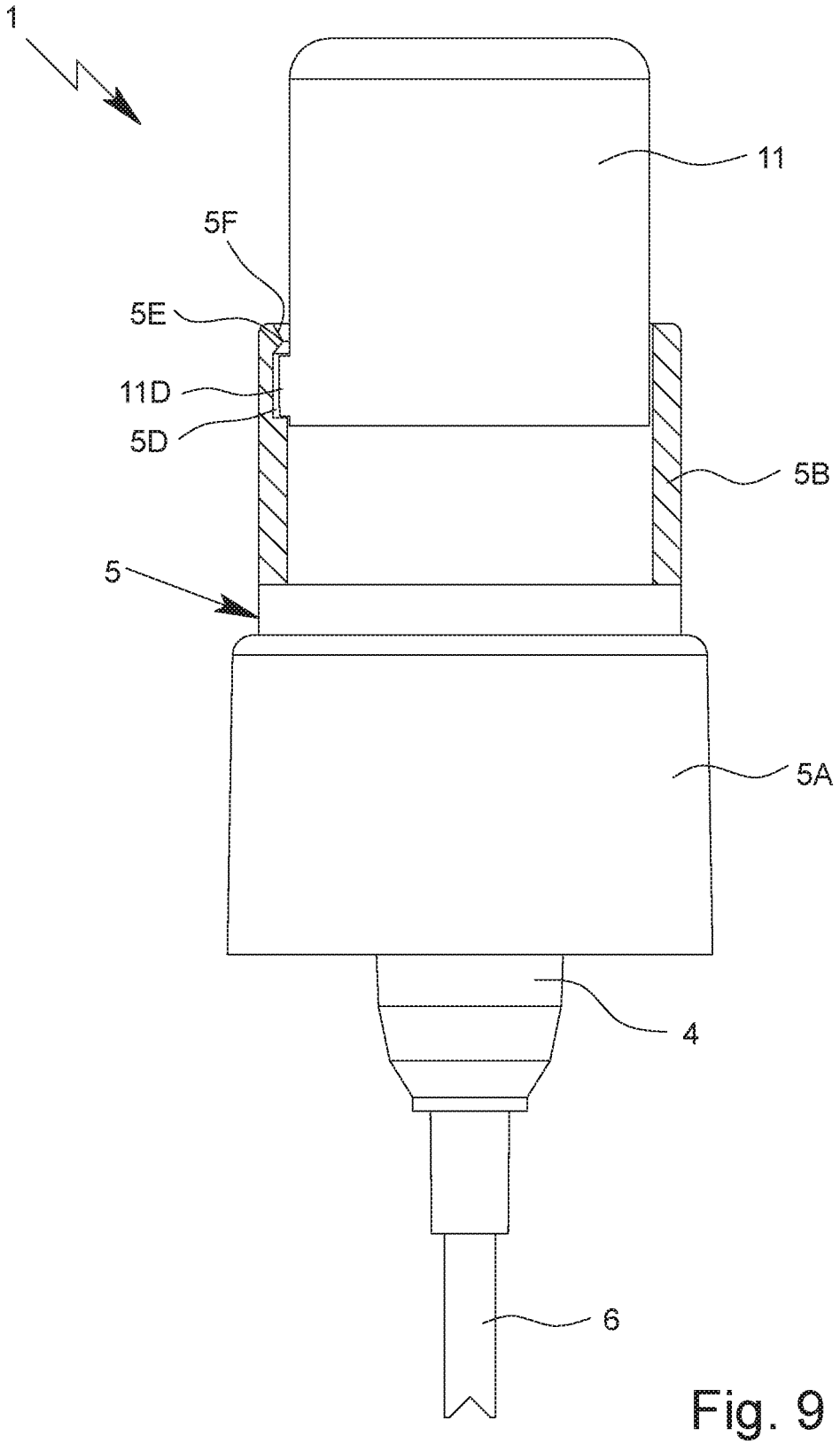
FIG. 9 shows a schematic section illustrating the engagement of the protective cap and of the retention section in the housing.

FIG. 9 shows a schematic section of the engagement of the protective cap 11 with an engagement portion, particularly a retention portion 11D preferably arranged on the outside and projecting radially outward into the housing 5 or its recess 5D.

Preferably, several, particularly three engagement portions or retention portions 11D and corresponding recesses 5D are distributed over the periphery in order to ensure reliable guiding and/or supporting of the protective cap 114 on or in the housing 5. The purpose of this is especially preferably to prevent tilting of the protective cap 11 under a load, e.g., upon depression, in the blocked position.

Especially preferably, the protective cap 11 is non-detachably connected to the dispensing device 1 or to the housing 5. In the depicted example, this is preferably achieved in that the recess 5D is closed or restricted toward the free end of the housing 5 or annular collar 5B, especially preferably by an edge 5E that projects radially inward, whereby the retention portion 11D cannot be moved axially or pulled out of the recess 5D. The protective cap 11 is thus preferably held or secured in a non-detachable manner on the housing 5 and hence on the dispensing device 1. However, other structural solutions are also possible.

Especially preferably, the protective cap 11 can be connected in a locking manner to the dispensing device 1 or to the housing 5, particularly through axial introduction or insertion of the protective cap 11 with its retention portions 11D into the associated recesses 5D. In the depicted example, the respective edge 5E is preferably provided for this purpose with an insertion chamfer 5F, as indicated in FIG. 9.

The dispensing device 1 preferably forms a resistance that must be overcome when rotating the protective cap 11 from the blocked position into the unblocked position and/or vice versa. Preferably, the resistance is achieved by a rib, narrowing or shoulder 5G in the movement path or recess 5D. In the depicted example, the narrowing or shoulder 5G is especially preferably formed by an axial projection of the wall of the recess 5D.

Especially preferably, the rib, narrowing or shoulder 5G is arranged in the first portion of the recess 5D and/or between the blocked position and unblocked position of the retention portion 11D in the recess 5D, as indicated schematically in FIGS. 6 to 8. However, other structural solutions are also possible.

The protective cap 11 and the spray head 9 are preferably coupled by means of a rotary coupling, particularly in such a way that they can be twisted to a limited extent relative to one another, for example by 20 to 45°, particularly such that, upon rotating from the unblocked position into the blocked position and vice versa, the protective cap 11 can be rotated to a limited extent relative to the spray head 9 and/or such that, upon rotation of the protective cap 11 from the blocked position into the unblocked position, the spray head 9 is also rotated into a predetermined delivery direction when the spray head 9 is oriented toward the blocked position before. It is thus achieved that the spray head 9 assumes a defined rotational position or orientation in the unblocked position and, accordingly, is aligned in a certain direction upon actuation of the dispensing device 1 and delivers the product 2.

The rotary coupling is preferably embodied such that the protective cap 11 can only be twisted by a preferred angle relative to the spray head 9 that corresponds to the angle for rotating between the unblocked position and blocked position and vice versa. As a result, the rotary coupling normally forms a rotatory freewheel between the protective cap 11 and the spray head 9. However, if the spray head 9 twists or has twisted in an undesired manner, a forced rotation of the spray head 9 back into the desired rotational position flush with the passage opening 11A and recess 5C is ensured by the rotary coupling when the protective cap 11 is rotated from the blocked position into the unblocked position.

Figure 10:
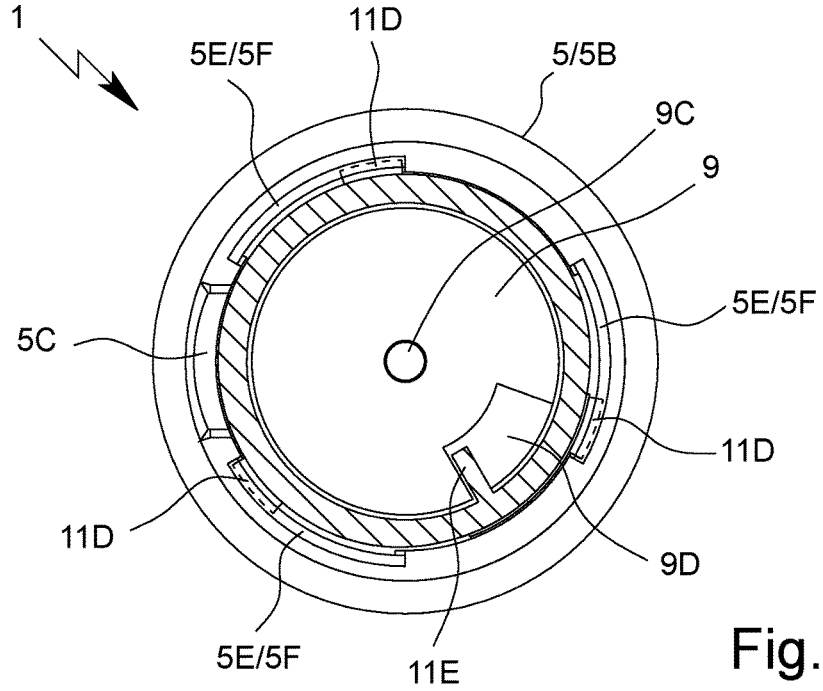
FIG. 10 shows a top view of the dispensing device with cutaway protective cap.

In the depicted example, the protective cap 11 preferably has a particularly rib-like engagement element 11E that engages axially or on the front side into an engagement opening 9D of the spray head 9, as indicated schematically in FIG. 10, which shows a top view of the dispensing device 1 without container 3 with cutaway protective cap 11. Especially preferably, the engagement of the engagement element 11E into the engagement opening 9D forms the aforementioned rotary coupling.

The engagement element 11E is preferably rib-like.

The engagement element 11E is arranged, preferably integrally formed, on the interior, preferably on the protective cap 11, for example at the closed end.

The engagement opening 9D is preferably formed on the front-side or upper end of the spray head 9.

The engagement opening 9D is preferably embodied in the manner of an annular portion.

However, other structural solutions for implementing the rotary coupling are also possible.

Individual aspects of the present invention can also be implemented independently of each other and in any combination.

LIST OF REFERENCE SYMBOLS

1 dispensing device
2 product
3 container
4 pump
5 housing
5A mounting portion
5B annular collar
5C recess
5D recess
5E edge
5F insertion chamfer
5G shoulder
6 riser tube
7 outlet element
8 return spring
9 spray head
9A inlet
9B sleeve portion
9C recess
9D engagement opening
10 nozzle
11 protective cap
11A passage opening
11B sleeve portion
11C mounting portion
11D retention portion
HE engagement element
A delivery direction
B direction of actuation

The invention claimed is:

1. A dispensing device for a liquid product with a housing, a spray head and a protective cap,
- wherein the protective cap covers the spray head on an outside,
- wherein the protective cap can be depressed together with the spray head to deliver product and/or pump the product,
- wherein the protective cap can be manually rotated between an unblocked position and a blocked position,
- wherein the protective cap can be depressed manually in the unblocked position together with the spray head, and
- wherein the protective cap is locked against manual depression in the blocked position,
- with at least one of the following features:
  - the dispensing device forms a resistance that must be overcome when rotating the protective cap from the blocked position into the unblocked position and/or vice versa, and/or
  - the protective cap and the spray head are coupled directly by a rotary coupling in such a way that the protective cap and the spray head can be twisted to a limited extent relative to one another, whereby, upon rotation of the protective cap from the blocked position into the unblocked position, the spray head is also rotated into a predetermined delivery direction when the spray head has been oriented toward the blocked position, and/or
  - the protective cap is transparent, and
- wherein the rotary coupling engages axially in the spray head.

2. The dispensing device according to claim 1, wherein the dispensing device has a projection or a shoulder for forming the resistance.

3. The dispensing device according to claim 2, wherein the housing includes the projection in a region of a movement path in order to constrict same and/or to form the resistance.

4. The dispensing device according to claim 1, wherein, the protective cap has at least one radially projecting retention portion that engages in a recess in the housing and can be moved along a movement path in the recess upon rotation and depression of the protective cap.

5. The dispensing device according to claim 4, wherein the protective cap is secured by the retention portion to prevent the protective cap from being pulled axially from the housing.

6. The dispensing device according to claim 4, wherein the protective cap is connected in a locking manner to the housing through axial insertion and/or in a non-detachable manner.

7. The dispensing device according to claim 1, wherein the spray head has an outlet opening or nozzle for the atomized delivery of the product.

8. The dispensing device according to claim 1, wherein the protective cap has a passage opening that unblocks an outlet opening of the spray head when the protective cap is in the unblocked position.

9. The dispensing device according to claim 1, wherein the dispensing device or the housing has or forms a pump.

10. The dispensing device according to claim 1, wherein the dispensing device or the housing has or forms a screw connection for mounting on a container.

11. The dispensing device according to claim 1, wherein the dispensing device has a container with or for the product.

12. A dispensing device for a liquid product with a housing, a spray head and a protective cap,
- wherein the protective cap covers the spray head on an outside,
- wherein the protective cap can be depressed together with the spray head to deliver product and/or pump the product,
- wherein the protective cap can be manually rotated between an unblocked position and a blocked position, wherein the protective cap can be depressed manually in the unblocked position together with the spray head, and wherein the protective cap is locked against manual depression in the blocked position, with at least one of the following features:

the dispensing device forms a resistance that must be overcome when rotating the protective cap from the blocked position into the unblocked position and/or vice versa, and/or the protective cap and the spray head are coupled directly by a rotary coupling in such a way that the protective cap and the spray head can be twisted to a limited extent relative to one another, whereby, upon rotation of the protective cap from the blocked position into the unblocked position, the spray head is also rotated into a predetermined delivery direction when the spray head has been oriented toward the blocked position, and/or the protective cap is transparent, and wherein the rotary coupling has an engagement element arranged on an interior and/or on a front side of the protective cap.

13. The dispensing device according to claim 12, wherein the dispensing device has a projection or a shoulder for forming the resistance.

14. The dispensing device according to claim 13, wherein the housing includes the projection in a region of a movement path in order to constrict same and/or to form the resistance.

15. The dispensing device according to claim 12, wherein, the protective cap has at least one radially projecting retention portion that engages in a recess in the housing and can be moved along a movement path in the recess upon rotation and depression of the protective cap.

16. The dispensing device according to claim 15, wherein the protective cap is secured by retention portion to prevent the protective cap from being pulled axially from the housing.

17. The dispensing device according to claim 12, wherein the spray head has an outlet opening or nozzle for the atomized delivery of the product.

18. The dispensing device according to claim 12, wherein the protective cap has a passage opening that unblocks an outlet opening of the spray head when the protective cap is in the unblocked position.

19. The dispensing device according to claim 12, wherein the dispensing device or the housing has or forms a pump.

20. The dispensing device according to claim 12, wherein the dispensing device or the housing has or forms a screw connection for mounting on a container.

21. The dispensing device according to claim 12, wherein the dispensing device has a container with or for the product.

22. The dispensing device according to claim 12, wherein the protective cap is connected in a locking manner to the housing through axial insertion and/or in a non-detachable manner.

23. A dispensing device for a preferably liquid product with a housing, a spray head and a protective cap, wherein the protective cap covers the spray head on an outside, wherein the protective cap can be depressed together with the spray head to deliver product and/or pump the product, wherein the protective cap can be manually rotated between an unblocked position and a blocked position, wherein the protective cap can be depressed manually in the unblocked position together with the spray head, and wherein the protective cap is locked against manual depression in the blocked position, with at least one of the following features:

the dispensing device forms a resistance that must be overcome when rotating the protective cap from the blocked position into the unblocked position and/or vice versa, and/or the protective cap and the spray head are coupled directly by a rotary coupling in such a way that the protective cap and the spray head can be twisted to a limited extent relative to one another, whereby, upon rotation of the protective cap from the blocked position into the unblocked position, the spray head is also rotated into a predetermined delivers direction when the spray head has been oriented toward the blocked position, and/or the protective cap is transparent, and wherein the rotary coupling has a preferably front-side engagement opening on the spray head.

24. The dispensing device according to claim 23, wherein the engagement opening is an annular portion.

25. The dispensing device according to claim 23, wherein the dispensing device has a projection or a shoulder for forming the resistance.

26. The dispensing device according to claim 25, wherein the housing includes the projection in a region of a movement path in order to constrict same and/or to form the resistance.

27. The dispensing device according to claim 23, wherein, the protective cap has at least one radially projecting retention portion that engages in a recess in the housing and can be moved along a movement path in the recess upon rotation and depression of the protective cap.

28. The dispensing device according to claim 27, wherein the protective cap is secured by retention portion to prevent the protective cap from being pulled axially from the housing.

29. The dispensing device according to claim 23, wherein the spray head has an outlet opening or nozzle for the atomized delivery of the product.

30. The dispensing device according to claim 23, wherein the protective cap has a passage opening that unblocks an outlet opening of the spray head when the protective cap is in the unblocked position.

31. The dispensing device according to claim 23, wherein the dispensing device or the housing has or forms a pump.

32. The dispensing device according to claim 23, wherein the dispensing device or the housing has or forms a screw connection for mounting on a container.

33. The dispensing device according to claim 23, wherein the dispensing device has a container with or for the product.

34. The dispensing device according to claim 23, wherein the protective cap is connected in a locking manner to the housing through axial insertion and/or in a non-detachable manner.

* * * * *